United States Patent [19]

Cuthbertson

[11] Patent Number: 4,676,319

[45] Date of Patent: Jun. 30, 1987

[54] FIRE FIGHTING TOOL AND METHOD

[75] Inventor: Robert H. Cuthbertson, Santa Barbara, Calif.

[73] Assignee: Ametek, Inc., Santa Barbara, Calif.

[21] Appl. No.: 697,217

[22] Filed: Jan. 30, 1985

[51] Int. Cl.[4] ..... A62C 31/22

[52] U.S. Cl. ..... 169/70; 169/62; 239/271

[58] Field of Search ..... 169/62, 70, 30, 24, 169/67, 25, 52; 173/57, 163, 73, 59, 79; 408/59, 57; 175/214, 170; 29/237; 239/DIG. 22, 271

[56] References Cited

U.S. PATENT DOCUMENTS

| | | | |
|---|---|---|---|
| 2,733,940 | 2/1956 | Millar | 29/237 |
| 2,857,005 | 10/1958 | Medlock | 169/70 R |
| 3,421,392 | 1/1969 | Bangerter et al. | 408/57 |
| 3,791,660 | 2/1974 | Bostley | 408/59 X |
| 3,820,606 | 6/1974 | Terayama | 239/271 X |
| 3,865,194 | 2/1975 | Chatfield, Jr. | 169/70 |
| 4,060,874 | 12/1977 | Furutsutsumi | 239/DIG. 22 |
| 4,147,216 | 4/1979 | Schneppe, Jr. et al. | 169/70 |
| 4,271,909 | 6/1981 | Chatfield, Jr. et al. | 169/70 |
| 4,340,327 | 7/1982 | Martins | 408/59 |

*Primary Examiner*—Jeffrey V. Nase
*Attorney, Agent, or Firm*—Koppel & Harris

[57] ABSTRACT

A fire fighting tool is described which is capable of both penetrating the wall of an enclosure, and dispensing a fire fighting agent into the interior of the enclosure. A drill bit or other penetrating device is carried at the forward end of an elongate shaft which is connected at its rear end to a drill motor or other appropriate actuating device. The shaft is surrounded by a barrel which receives a fluid fire fighting agent and includes a series of outlet openings at its forward end through which the agent is dispensed. The shaft is thus surrounded and cooled by the agent during the penetration operation. A leaky bearing is provided at the forward end of the barrel, and is specially configured along with the shaft and drill bit to induce a leakage of agent through the bearing and onto the bit and surrounding enclosure wall during drilling, thereby cooling the various parts and lessening the risk of an explosion. The barrel is designed to hold the tool in place once it has been inserted into the enclosure.

14 Claims, 6 Drawing Figures

FIRE FIGHTING TOOL AND METHOD

BACKGROUND OF THE INVENTION

1. Field of the Invention

This invention relates to an apparatus and method for penetrating a walled enclosure to dispense a fire fighting agent within the enclosure.

2. Description of the Prior Art

Physically entering an aircraft or similar enclosure to fight a fire or dispense a fire fighting agent in an explosive atmosphere can be very dangerous, exposing the fire fighter to an explosion or other catastrophe. The classical technique used to fight fires in a building structure involves breaking through windows with an axe or other tool, breaking down or chopping through a door or chopping through a wall or roof. This method has proven to be unsatisfactory in many instances. When windows are broken there is a danger of injury from glass cuts. When the fire inside the building is located close to the wall or door being penetrated, there is also a danger from hot gases and flames, or an explosive action when the building is penetrated. In addition, the use of axes or other penetrating tools is time-consuming and requires considerable effort, allowing the fire to continue burning and spread while the wall is being penetrated.

As a result of the above problems, various devices have been developed for more rapidly penetrating a walled enclosure and introducing a fire fighting agent into the interior. In U.S. Pat. No. 4,271,909 to Chatfield, Jr. et al., a modular fire fighting tool is disclosed in which a cylindrical barrel with a drill bit or other penetrating tool at its front end extends forward from a turbine. The turbine is driven by water or other fire extinguishing fluid, and rotates the drill bit to cut a hole in the building wall. The barrel is then inserted into the interior of the building, and a valve is operated which allows water to flow down the barrel and out through outlet openings located behind the bit to extinguish the fire. In U.S. Pat. No. 3,865,194 to Chatfield, Jr. another hydraulically operated fire extinguishing drill is disclosed. After a hole has been cut in the enclosure wall and the barrel inserted, a valve is operated to permit water to issue from the end of the tool and extinguish the flame. U.S. Pat. No. 2,251,175 to Tappe is somewhat similar in concept to the '909 patent above, in that it uses a hydraulically operated circular saw to cut a hole in a vessel, with a valve controlling the flow of water out of the barrel once the hole has been cut. The tool is mounted on an extension carried by a mobile support frame. Another penetrator/barrel arrangement is disclosed in U.S. Pat. No. 4,147,216 to Schnepfe, Jr. et al. In this device, which is particularly designed for aircraft fires, a cartridge is fired to drive the cutter through the aircraft skin. The barrel is then moved through the opening and a fire fighting agent is dispensed into the interior of the aircraft. Another device designed for fighting aircraft fires is disclosed in U.S. Pat. No. 2,857,005 to Medlock. In this patent a penetration tool is carried at the end of an extension arm mounted on a truck. The tool punches through the aircraft shell by the forward motion of the truck, which then backs away to leave an outlet in place through which a fire fighting agent can be sprayed into the interior of the aircraft.

The foregoing devices represent improvements in the fire fighting art, in that they permit a more rapid penetration of an aircraft or other enclosure to fight a fire inside. However, they do not solve all of the potential problems. A considerable amount of heat is generated when drilling through an aircraft skin or the like, and hot chips as wall as sparks can be discharged into the interior of the craft. This excessive heat can be very dangerous in the presence of an explosive atmosphere inside the craft. Furthermore, a considerable back pressure is developed when the tool is inserted into a craft and begins to dispense a fire fighting fluid. This pressure can make it difficult to control the tool, and may even force the tool back out of the craft. In addition, some of the prior devices are quite cumbersome and difficult to manually manipulate.

SUMMARY OF THE INVENTION

In view of the above problems associated with the prior art, the object of the present invention is the provision of a novel and improved fire fighting apparatus and method for conveniently and quickly penetrating an enclosure such as an aircraft to dispense a fire fighting agent into the interior of the enclosure.

Another object is the provision of such an apparatus and method in which both the penetrating mechanism and the surrounding wall are cooled in the course of penetrating the wall, and in which a fluid dispensing barrel is securely held in place inside the craft once penetration has been achieved.

In the achievement of these and other objects of the invention, a combined penetrating and fire fighting tool is provided with a housing having an inlet orifice, an outlet orifice and a fluid passage communicating between the two. A valve controls the flow of a fire fighting fluid into the inlet orifice, while an elongate dispensing barrel is coupled to the outlet orifice to receive fire fighting fluid therefrom. The barrel includes a plurality of outlets near its forward end for dispensing the fire fighting fluid.

A motor is also mounted to the housing, with a drive shaft extending from the motor through the housing and barrel and terminating forward of the barrel. A wall penetrating means such as a drill bit is carried at the forward end of the shaft. The shaft is axially centered within the barrel by means of a bearing which substantially closes the forward end of the barrel and includes a central opening through which the shaft extends. The valve is adapted to admit a flow of fire fighting fluid into the housing and barrel when the motor is operated, thereby reducing the heating effects of the penetration on the shaft.

In a preferred embodiment, the outer shaft diameter is slightly less than the inner diameter of the bearing opening, and the penetrating means comprises a drill bit which includes a plurality of tapered cutting vanes. The motor rotates the shaft and drill bit with an angular velocity sufficient for the rotating vanes to establish a reduced pressure immediately forward of the bearing, thereby drawing fire fighting fluid through a leakage path between the shaft and bearing and onto the bit and the adjacent wall to provide further cooling. The forward end of the bearing opening has a bellmouth shape, and the rearward portions of the drill bit vanes adjacent the shaft generally conform in shape to the bellmouth to enhance the suction effect. The bearing also preferably includes a plurality of bores which extend generally radially outward from the bearing opening and are adapted to both receive a tightening wrench, and to provide additional outlets for fluid drawn into the gap between the shaft and bearing during drill bit rotation.

As an additional feature, the cross-section of the barrel is approximately equal to the size of the opening formed by the penetrating means, and the periphery of the barrel includes a series of rearward directed flutes. Once the barrel has been inserted through the penetrated opening, it is retained against rearward movement by an engagement of the flutes with the surrounding wall.

Further objects and features of the invention will be apparent to those skilled in the art from the following detailed description of preferred embodiments, taken together with the accompanying drawings, in which:

DESCRIPTION OF THE DRAWINGS

FIG. 6 is a side elevational view of a different embodiment of the invention employing an impact penetrating device.

DETAILED DESCRIPTION OF PREFERRED EMBODIMENTS

Figure 1:
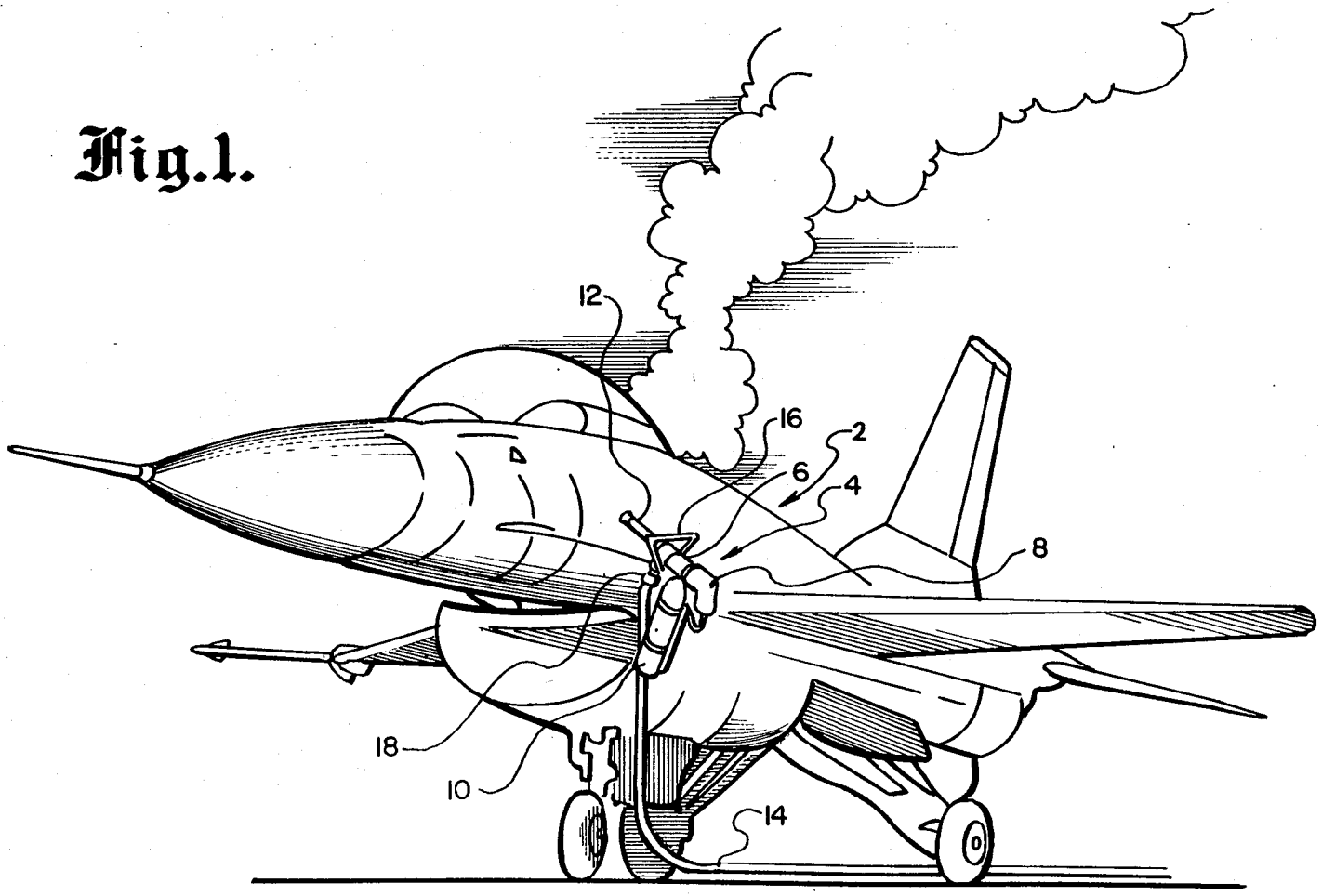
FIG. 1 is a perspective view of an aircraft with the fire fighting tool of the present invention inserted through its skin to extinguish a fire inside the craft.

The present invention can be used to fight fires in aircraft, buildings, homes, watercraft, railroads cars and locomotives, cars and trucks, warehouses, trailers, etc. It can be hand-carried or mounted on an aerial ladder, boom, crane or other device capable of bringing it to a hard to reach fire location such as the top of a building or other tall structure. A preferred form of the invention, designed to be carried and used by hand, is shown in FIG. 1 in use on an aircraft 2 suffering from an internal fire. The tool 4 includes a housing 6, at the rear of which a pneumatically operated drill motor 8 is mounted. A compressed air canister 10 is mounted to the underside of the housing to supply the motor 8 with a pressurized air supply, while an elongate barrel 12 extends forward from the housing and provides a flow path for introducing a fire fighting agent into the interior of the aircraft. A hose 14 is coupled to the underside of the housing and delivers an appropriate fire fighting fluid, depending upon the type of fire to be extinguished. A remote container for the agent can be provided, with hose 14 being long enough to deliver it to the tool. A handle 16 is provided on the upper side of the housing to assist in manipulating the tool.

As shown in FIG. 1, the aircraft skin has been penetrated and the barrel 12 inserted through the opening so that its forward end is inside the aircraft. In this operative position a valve 18 on the underside of the housing can be fully opened to admit the fire fighting agent from the hose 14 into the housing 6, and thence through barrel 12 into the interior of the craft. The barrel is specially designed so that the tool can be left unattended and will not come out from the opening in the aircraft while the fire fighting agent is being dispensed. This is an important safety advantage, since it permits the operating personnel to leave the immediate area of the aircraft in case of an explosion.

Figure 2:
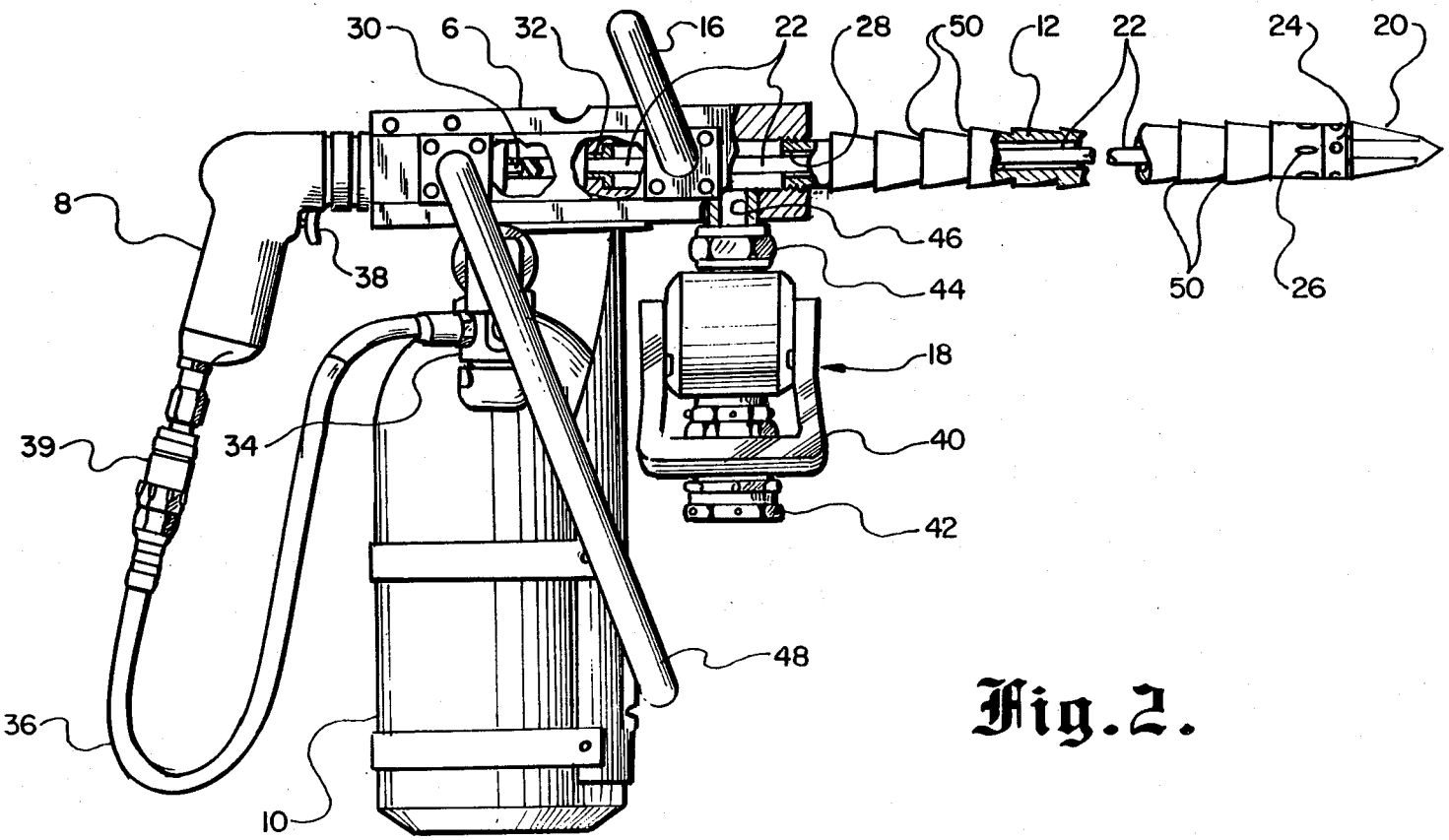
FIG. 2 is a partially cutaway side elevational view of one embodiment of the fire fighting tool.
Figure 3:
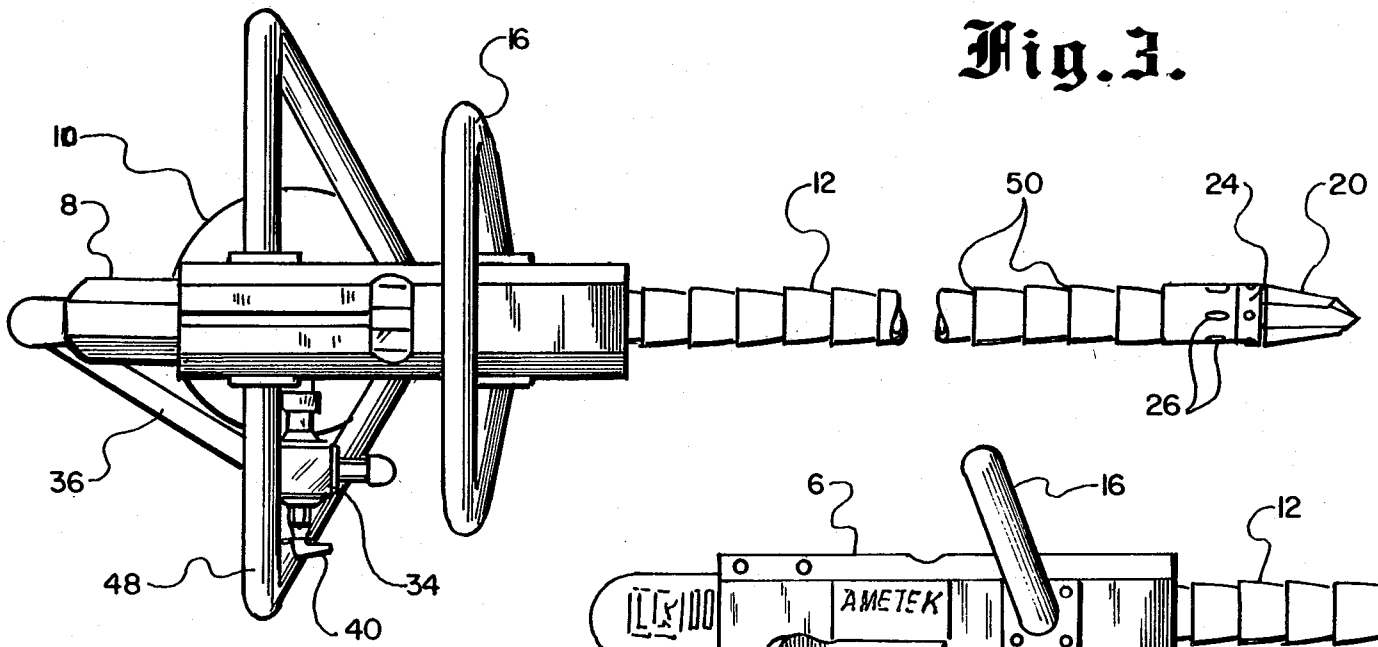
FIG. 3 is a plan view of the tool.

Further details of the tool are shown in FIGS. 2 and 3. A drill bit 20 is carried at the forward end of a drive shaft 22 immediately forward of the barrel 12. The drive shaft 22 extends through a central opening in a bronze bearing 24 screwed onto the forward end of the barrel, and extends back through the barrel and into housing 6 where it is coupled to the drive motor 8. A plurality of forward slanted outlet openings 26 are circumferentially spaced about the forward end of barrel 12 just back from bearing 24. Openings 26 are designed to dispense pressurized fire fighting fluid from within the barrel in a generally forward and lateral direction at a flow rate of 5 pounds/second of Halon.

Barrel 12 is threaded into an orifice 28 at the forward end of housing 6, while drive motor 8 is implemented as a pneumatically driven drill motor inserted into the rear of the housing. Motor 8 is capable of producing over 300 inch pounds of torque at 90 PSIG air supply pressure. A rotating drive stub 30 extends forward from the motor and is threaded into an axial opening at the rear of drive shaft 22 to rotate the shaft. A support bearing-/seal 32 is positioned within the housing between the motor and outlet orifice to provide additional lateral support for the drive shaft and seal the pressurized agent from coming out of housing 6.

Motor 8 is preferably powered by the precharged pneumatic canister 10, which is mounted directly to the underside of housing 6 by an appropriate fitting. The canister is preferably secured to the housing by means of quick acting, spring loaded, 90° turn fasteners secured to stainless steel straps for ease of assembly and periodic interchange of canisters, if desired. The canister, which is preferably about 21 cubic feet in volume, can be charged to 3,000 PSIG by compressed air facilities typically used for charging breathing air bottles used by fire fighters. A conventional SCUBA first stage regulator 34 controls the pressure of air supplied from the storage canister at 100 PSIG. Air is supplied to the drill motor 8 through hose 36, with flow initiated by an index finger actuated trigger 38 on the motor. An automatic lubricator 39 at the inlet of the drill motor automatically lubricates the drill motor as it runs. The regulator is also preferably equipped with a safety relief valve set at 150 PSIG, and has a hand lever 40 on top that can be operated to vent air trapped between the regulator and drill motor after use, if desired, or to test the relief valve.

The particular type of drive motor employed is not critical to the invention, and other drive devices such as air turbines, water turbines, hydraulic drive motors or electrical motors could be used. The type of drive motor employed must of course be coordinated with the particular type of penetrating mechanism carried at the forward end of the drive shaft. While a particular type of penetrating device is shown in the accompanying drawings, other devices such as hole saws, body hole cutters, masonry drills, wood drills, standard high speed drills, ceramic drills or fly cutters could also be used, depending upon the desired applications.

As an alternate to a portable air supply such as canister 10 mounted directly on the tool, the air supply could be provided from a remote location such as a fire or rescue truck, with a flexible hose of suitable length connecting the air supply to the fire fighting tool. While a fixed air supply may reduce the mobility of the fire fighting tool in certain applications, it allows many holes to be drilled into a burning aircraft without interruption. For strong aircraft air frame wall constructions, canister 10 is limited to an air charge sufficient to pierce only about six to eight holes into the aircraft.

A fluid fire fighting agent is admitted into the tool through valve 18, which is preferably a ball valve manually operated by means of handle 40. Various types of fire fighting agents can be used, depending upon the type of fire for which the tool is intended. For example, halon, freon, carbon dioxide, foam or water could be used. Valve 18 includes a threaded quick disconnect coupler 42 which is adapted to be coupled to a quick disconnect nipple on the agent supply hose to receive the fire fighting agent from a remote source, and an outlet fitting 44 which is securely threaded into an opening 46 formed on the underside of housing 6 and slightly back from the housing outlet orifice 28. With valve 18 open, the fire fighting agent is free to flow through the valve into inlet orifice 46, through the forward end of the housing, and out through housing outlet orifice 28 to the barrel. A flow of the agent back toward the motor is restricted by bearing/seal 32. Valve handle 40 can be set at any desired intermediate position between full open and full closed to produce a restricted flow of agent into the barrel.

In addition to the forward handle 16, a rear handle 48 extends laterally outward from the housing and down over canister 10. The front and rear handles are used to carry the tool and to hold it in place during drilling operations. The rear handle 48 also protects the air canister and regulator assembly from damage when the fire fighting tool is laid on the ground, placed in storage, or operated.

Barrel 12 extends forward from the housing a distance of approximately 15 inches, and is 1.188 inches in diameter. It includes a series of 14 regularly spaced circumferential undercuts or flutes 50 which face rearward toward the housing. Drill bit 20 in configured to drill a hole approximately 1.2 inches in diameter, permitting the barrel to be inserted forward with a close fit within the opening. Once positioned within the opening with its dispensing end inside the craft, the barrel is restricted against rearward motion by the engagement of flutes 50 with the surrounding walls of the drilled opening. This helps to hold the tool in place against movement out of the craft when a full flow of fire fighting fluid is initiated. It also permits the operator to move to a safer area and leave the tool unattended as it is dispensing the agent within the craft.

Figure 4:
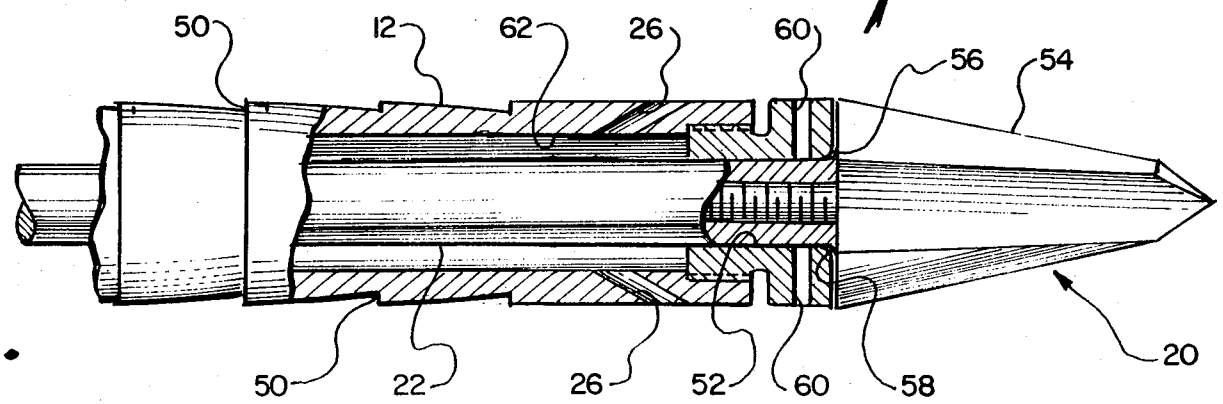
FIG. 4 is a fragmentary partially sectional view showing the forward end of the dispensing barrel and drill bit used for penetrating an enclosure.

FIG. 4 shows details of the forward end of the barrel and drill bit. Bearing 24 is screwed into the open end of barrel 12, substantially closing off the end of the barrel. The bearing has an axial opening 52 through which drive shaft 22 passes. The shaft diameter is held to a maximum of 0.50 inches, while the inside diameter of bearing opening 52 is slightly larger, preferably within the range of 0.502–0.505 inches. While providing a close enough fit to hold the drive shaft securely in place against excessive vibration, the slight gap left between the bearing opening and shaft provides for a small amount of advantageous leakage during drilling.

Drill bit 20 is preferably formed from M-40 cobalt or other high speed steel capable of drilling holes through an aircraft skin without frequent re-sharpening. It has a plurality of tapered cutting vanes 54 which are formed with an incline of 20° to horizontal, a cutting tip angle of 82° and are 2 inches long. The bit is silver brazed or spin-welded to the drive shaft.

The precise shapes and relative positioning of the drill bit and bearing opening are designed to enhance a partial vacuum created immediately forward of the bearing when the bit is rotated. This reduction in pressure draws fire fighting fluid from within the barrel out through the gap between the drive shaft and bearing opening and onto the drill bit as it is drilling into the wall of an aircraft. This induced leakage considerably cools the drill bit and the portion of the aircraft wall that is being drilled, thereby substantially reducing the risk of an internal explosion within the aircraft due to excessive heating or sparks at the drilling site. It has been discovered that, when the bearing opening 52 terminates at its forward end in an outward flaring bellmouth curve 56 and the drill bit vanes join the shaft at a similarly shaped bellmouth curve 58, the amount of leakage induced from the interior of the barrel is considerably increased. Designing the bearing and drill bit to optimize this leakage is important, since the gap between the drive shaft and bearing opening must be kept quite small to avoid excessive vibrations of the shaft and drill bit. In the embodiment shown the bellmouth is formed with a radius of 0.12 inch. With the drill bit spaced slightly forward of the bearing, preferably by about 0.02–0.04 inch, a substantial pressure differential is established across the bearing when the drill bit is operated at full speed, causing a sufficient amount of fire fighting agent from within the barrel to leak out through the bearing and cool the drill bit and the adjacent portion of the wall.

Bearing 24 also includes four radial bores 60 spaced 90° from each other and extending from the central bearing opening to its periphery immediately behind bellmouth curve 56. Bores 60 provide engagement points for a spanner wrench used to tighten the bearing onto the barrel, and also provide additional outlets for the leakage of agent during drilling. The bearing is threaded into the end of the barrel by means of a left-handed threading arrangement, which causes the connection between the bearing and barrel to tighten when the drive shaft is rotated.

Outlet openings 26 are drilled into the barrel immediately behind the bearing reception area. Eight outlet openings are preferably spaced evenly around the barrel, slanted forward at about 25° to the barrel axis with diameters of about 0.125 inch. Due to the angle of the outlets, the fire fighting agent is dispensed in a forward and lateral direction, and can be used to cool the wall of the aircraft in the vicinity of the bit during drilling as well as dispensing the agent into the interior of the craft after drilling has been completed.

The longitudinal inside bore 62 which extends through the entire length of the barrel is preferably about one inch in diameter, while the outside diameter of drill shaft 22 is 0.5 inches in diameter. Thus, substantially the entire outer surface of the drill shaft is exposed to the cooling inside barrel environment for the entire length of the barrel, except at the bearing.

In operation, ball valve 18 is opened slightly at the beginning of a drilling operation to admit a relatively low flow of fire fighting agent into the barrel. The tip of the drill bit is then placed against the outside of the aircraft or other enclosure to be drilled, and motor trigger 38 is depressed to begin the drilling operation. The fire fighting fluid flows down the length of the barrel during drilling, surrounding and cooling the shaft. When halon is used as the agent, it is introduced into the barrel as a liquid and is heated and vaporized during its transit down the barrel (the vaporization temperature of halon is about 70° F.). Vaporized halon is then sucked through the gap between the drill shaft and bearing opening under the influence of the partial vacuum created immediately forward of bearing 24 by the rotating drill bit, and flows onto the drill bit and adjacent portion of the aircraft shell to provide a cooling action. An additional but smaller amount of halon is drawn out and forward through the bearing bores 60, and the agent is also dispensed in a generally forward direction through barrel openings 26 to cool the aircraft shell around the bit.

Once the wall has been fully penetrated the barrel is inserted in far enough so that outlet openings 26 are inside the craft. Valve 18 is then fully opened, causing the fire fighting agent to be sprayed out of the eight outlet openings 26 at a flow rate of about 5 lbs./second for the embodiment illustrated in FIGS. 1–4. At this point the tool can be left unattended, with the barrel flutes 50 engaging the surrounding wall of the craft to hold the tool in place. For particularly dangerous environments, the fire fighting tool could be remotely operated.

Figure 5:
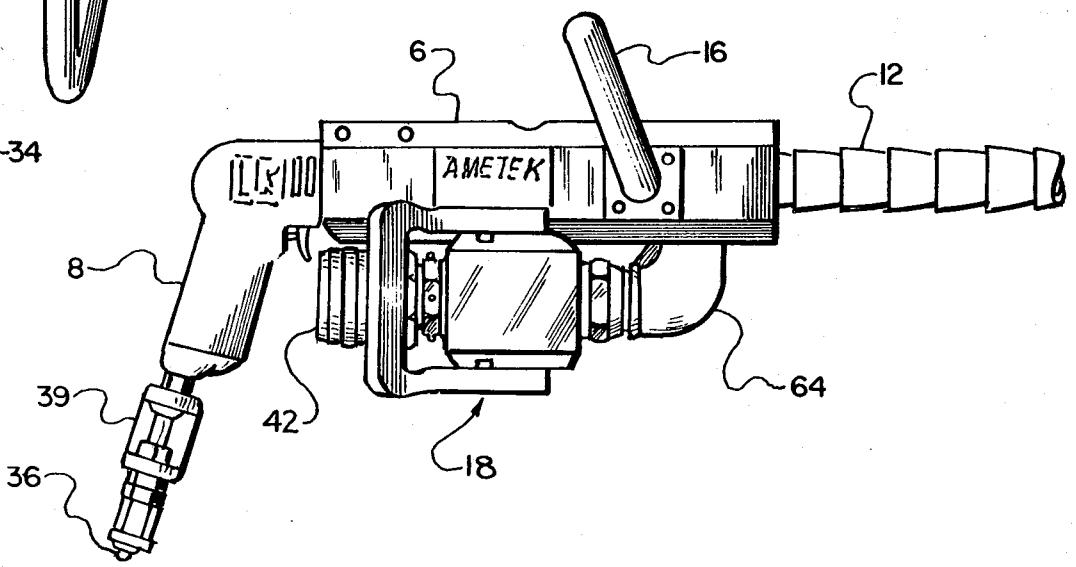
FIG. 5 is a side elevational view of another embodiment of the tool.
Figure 5:
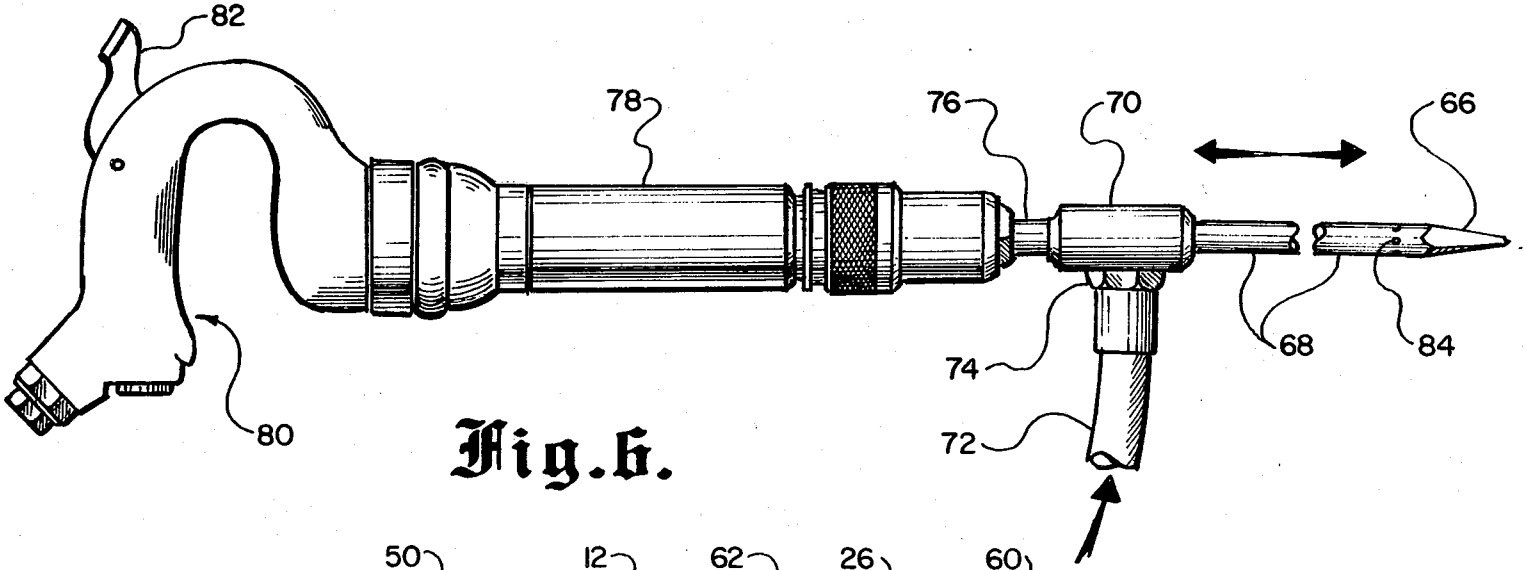

Another embodiment of the invention, in which a remote air supply for the drill motor is used, is shown in FIG. 5. In this figure the same reference numerals are used as in FIG. 2 for analogous components. The principal difference is the elimination of rear handle 48 and the provision of an elbow 64 which couples valve 18 to housing 6. The valve assembly is positioned more compactly on the underside of the housing, with its entrance orifice 42 directed rearwardly towards the handle of drill motor 8. With this configuration the hose used to supply fire fighting agent to the valve can conveniently be tied together at periodic points with the air hose supplying pressurized air to the drill motor.

A further embodiment of a penetrating/fire fighting tool is shown in FIG. 6. Instead of a rotating drill bit, an impact punch 66 is used in this embodiment to penetrate an enclosure. The punch is carried at the forward end of a shaft 68, which extends into a coupling 70 that also receives a fire fighting agent through a hose 72 connected to a quick disconnect coupling fitting 74. The opposite side of coupling 70 from shaft 68 is attached to another shaft 76 which extends into a housing 78 and is therein engaged by an impact drive motor 80. The motor includes a thumb trigger 82 which, when depressed, operates the motor to rapidly oscillate shaft 76, coupling 70 and shaft 68 in a reciprocating motion, causing the impact head 66 to penetrate the wall of the aircraft or other enclosure containing the fire. A plurality of forward directed outlet openings 84 are formed in shaft 68 immediately behind impact head 66, and direct a fire fighting agent inside the hollow shaft onto the exterior wall during penetration. Once penetration has been achieved, a full flow of agent is activated through hose 72 into coupling 70, from whence it flows through the hollow shaft 68 and out openings 84 to extinguish the fire.

Various embodiments of a novel fire fighting tool, which is very convenient to use and considerably reduces the chance of an explosion while penetrating into a burning enclosure, have thus been shown and described. As numerous modifications and alternate embodiments will occur to those skilled in the art, it is intended that the invention be limited only in terms of the appended claims.

I claim:

1. A fire fighting tool for extinguishing a fire within an aircraft, building or other walled enclosure, comprising:

a housing adapted to receive a fluid fire fighting agent, an outlet barrel extending from the housing and adapted to receive a fire fighting fluid therefrom, the portion of the barrel distant from the housing including means for dispensing fluid from within the barrel, a solid, thermally conductive shaft extending through the barrel and carrying a penetrating means forward of the barrel the shaft forming a thermally conductive shaft and penetrating means, and controllable actuating means engaging the shaft to actuate the penetrating means, the penetrating means when actuated being adapted to penetrate an enclosure wall to admit the dispensing means of the barrel into the enclosure, the barrel being adapted to transmit fire fighting fluid around the shaft from the housing to the dispensing means, whereby the shaft acts as a thermally conductive heatsink to dissipate the heat generated by the penetrating means.

2. The fire fighting tool of claim 1, the barrel dispensing means comprising a plurality of outlets located around the barrel and adapted to dispense fire fighting fluid from within the barrel onto the exterior of the enclosure during the drilling and penetration of an enclosure wall.

3. The fire fighting tool of claim 1, further comprising a bearing at the forward end of the barrel, the bearing including a shaft opening and supporting the shaft at a position inward of the barrel walls.

4. The fire fighting tool of claim 3, the bearing opening being leaky around the shaft to permit the escape of fire fighting fluid from the barrel onto the penetrating means and the enclosure wall, and the outlet barrel comprising an elongate member extending from the housing generally to the penetratng means and fixed against rotation with respect to the housing.

5. The fire fighting tool of claim 4, the penetrating means comprising a drill bit at the forward end of the shaft, the drill bit including a plurality of tapered vanes adapted to drill through the walls of an enclosure, the actuating means being adapted to rotate the shaft and drill bit with an angular velocity sufficient for the rotating vanes to establish a reduced pressure immediately forward of the bearing to draw fire fighting fluid from within the barrel out through the leaky bearing and onto the bit and the enclosure wall during penetration.

6. The first fighting tool of claim 5, the bearing opening terminating at its forward end in a bellmouth shape, the rearward portions of the drill bit vanes adjacent the shaft generally conforming in shape to the bellmouth and spaced forward of the bearing.

7. The fire fighting tool of claim 6, the drill bit being spaced forward of the bearing by approximately 0.02–0.04 inch.

8. A fire fighting tool for extinguishing fires within an aircraft, building or other walled enclosure, comprising:

a housing having an inlet orifice, an outlet orifice, and a fluid passage communicating between the inlet and outlet orifices, valve means for controlling the flow of a fire fighting fluid into the inlet orifice, a motor mounted to the housing, an elongate outlet barrel coupled to the housing and fixed against rotation with respect to the housing, the barrel adapted to receive fire fighting fluid from the housing through the outlet orifice and includes a plurality of outlets in the vicinity of its forward end opposite the housing for dispensing fire fighting fluid, a solid, thermally conductive shaft concentric with the barrel and extending from the motor through the housing and barrel and terminating forward of the barrel, a wall penetrating means carried at the forward end of the shaft with a thermally conductive contact between the shaft and the penetrating means, a shaft bearing substantially closing the forward end of the barrel and including a generally central opening, the shaft extending through the bearing opening and supported by the bearing in a position spaced away from the barrel walls, and a motor control for operating the motor to actuate the penetrating means via the shaft, the valve means being adapted to admit a flow of fire fighting fluid into the housing and barrel and the barrel transmitting the fire fighting fluid around the shaft to the penetrating means, whereby the shaft acts as a thermally conductive heatsink to dissipate heat generated by the penetrating means.

9. The fire fighting tool of claim 8, wherein the barrel is an elongate member extending from the housing generally to the penetrating means with the barrel outlets being slanted to dispense fire fighting fluid from within the barrel onto the enclosure wall during penetration, and in a forward and lateral direction when penetration is completed and the barrel has been inserted into the enclosure.

10. The fire fighting tool of claim 8, the outer diameter of the shaft being slightly less than the inner diameter of the bearing opening, the penetrating means comprising a drill bit carried at the forward end of the shaft and including a plurality of tapered vanes, the motor being adapted to rotate the shaft and drill bit with an angular velocity sufficient for the rotating vanes to establish a reduced pressure immediately forward of the bearing to draw fire fighting fluid from within the barrel through the gap between the shaft and bearing opening and onto the bit and the enclosure wall during penetration.

11. The fire fighting tool of claim 10, the bearing opening terminating at its forward end in a bellmouth shape, the rearward portions of the drill bit vanes adjacent the shaft generally conforming in shape to the bellmouth and spaced forward of the bearing.

12. The fire fighting tool of claim 11, the drill bit being spaced forward of the bearing by approximately 0.02–0.04 inch.

13. A method of fighting fires within a walled enclosure, comprising the steps of:

operating a penetrating means at the end of a shaft to penetrate a wall of the enclosure, enclosing the shaft to prevent fluid loss, causing fluid to flow around the outer surface of the shaft, dispensing a fire fighting fluid onto the penetrating means and the outer surface of the shaft during operation of the penetrating means to cool the shaft, dispensing a fire fighting fluid onto the penetrating means and the surrounding enclosure wall during penetration, conducting heat from the penetrating means through the shaft and dissipating the heat through the fire fighting fluid, and dispensing a fire fighting fluid into the enclosure through the penetration made by the penetrating means.

14. The method of claim 13, the penetrating means comprising a rotatable drill bit, wherein the drill bit is rotated to penetrate the enclosure wall with an angular velocity sufficient to create a pressure differential to draw fire fighting fluid onto the drill bit and the enclosure wall during penetration, thereby helping to cool the bit and the enclosure wall.

* * * * *